US007089891B2

(12) United States Patent
Yuasa et al.

(10) Patent No.: US 7,089,891 B2
(45) Date of Patent: Aug. 15, 2006

(54) TWO-CYCLE COMBUSTION ENGINE

(75) Inventors: Tsuneyoshi Yuasa, Kobe (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/862,667

(22) Filed: Jun. 7, 2004

(65) Prior Publication Data

US 2004/0255883 A1 Dec. 23, 2004

(30) Foreign Application Priority Data

Jun. 9, 2003 (JP) ..... 2003-163108
Jun. 23, 2003 (JP) ..... 2003-177509

(51) Int. Cl.
*F02B 33/04* (2006.01)

(52) U.S. Cl. ..... 123/73 A; 123/73 PP

(58) Field of Classification Search ..... 123/73 PP, 123/73 A, 73 S, 65 A, 73 DA, 74 AA, 73 AD
See application file for complete search history.

(56) References Cited

U.S. PATENT DOCUMENTS 4,109,622 A * 8/1978 Fujikawa et al. ..... 123/73 A

FOREIGN PATENT DOCUMENTS

| | | | |
|---|---|---|---|
| JP | 56012008 A | * | 2/1981 |
| JP | 2000-179346 | | 6/2000 |
| JP | 2001-193557 | | 7/2001 |
| WO | WO 2004038195 A1 | * | 5/2004 |

* cited by examiner

*Primary Examiner*—Henry C. Yuen
*Assistant Examiner*—Hyder Ali

(57) ABSTRACT

To provide a two-cycle combustion engine, in which the blow-off of the air-fuel mixture used as the scavenging gas is avoided and the combustion efficiency of the air-fuel mixture can be increased, the two-cycle combustion engine includes first and second scavenge passages (11, 12) for supplying the air-fuel mixture (M) from a crank chamber (2*a*) into the combustion chamber (1*a*) of the combustion engine. Each of the first and second scavenge passages (11, 12) has a lower end portion thereof extended to assume the position where it confronts an outer end face of a bearing (81) for the crankshaft (8), so that the air-fuel mixture (M) within the crank chamber (2*a*) can be introduced into the first and second scavenge passages (11, 12) through the bearing (81) and be then supplied into the combustion chamber (1*a*) through the first and second scavenge passages (11, 12).

11 Claims, 16 Drawing Sheets

TWO-CYCLE COMBUSTION ENGINE

CROSS-REFERENCE TO THE RELATED APPLICATIONS

United State Patent Application entitled "Two-cycle Combustion Engine With Air Scavenging System" and filed even day herewith in the United States with the Convention priority based on the Japanese Patent Application No. 2003-163108, filed in Japan on Jun. 9, 2003, the filing number of which has not yet been allocated.

BACKGROUND OF THE INVENTION

1. Field of the Invention

The present invention generally relates to a two-cycle combustion engine suitable for use as a power plant for a compact working machine such as, for example, a bush cutter and, more particularly, to the two-cycle combustion engine of a design effective to minimize the blow-off phenomenon of exhaust gases in which a portion of the air-fuel mixture used as a scavenging gas is discharged in the form of an unburned gas.

2. Description of the Prior Art

An example of the two-cycle combustion engine of the type referred to above has a scavenging path for supplying a scavenging gas into a combustion chamber including a cylinder-side scavenging passage and a crankcase-side scavenging passage. The crankcase-side scavenging passage is made up of i) a gap defined between an upper inner peripheral surface of the crankcase and the outer peripheral surface of the reciprocating piston and ii) a connecting portion defined between an upper end of this gap and a lower end of the cylinder-side scavenging passage. Also, in this two-cycle combustion engine, in order to facilitate supply of an air-fuel mixture during a high speed engine operating condition, an auxiliary scavenge passage for supplying the air-fuel mixture into the cylinder-side scavenge passage is defined at the interface between left and right components of the crankcase and also at the interface between the crankcase and the cylinder block, to thereby communicate between the interior of the crankcase and the scavenging path. See, for example, the Japanese Laid-open Patent Publication No. 2000-179346, particularly FIGS. 5 and 6 and their related description made therein.

With this construction the prior art two-cycle combustion engine aims at avoiding the blow-off of the air-fuel mixture by allowing the air-fuel mixture within the crankcase to flow towards the cylinder-side scavenge passage through the crankcase-side scavenge passage that is defined by the narrow gap and the connecting portion.

However, it has been found that the cylinder-side scavenge passage employed in the above discussed prior art two-cycle combustion engine has an overall length so small that in a high speed operation of the engine, the velocity of flow of the air-fuel mixture entering the cylinder-side scavenge passage through the gap for the introduction of the air-fuel mixture into the scavenging path in the outer periphery of the reciprocating piston tends to increase and, therefore, the blow-off phenomenon is liable to occur in which the air-fuel mixture, particularly the enriched air-fuel mixture containing a large amount of fuel component and nearly in a liquid phase, is abruptly injected into a combustion chamber from the scavenging port and is subsequently discharged from an exhaust port.

Also, with respect to the supply of the air-fuel mixture during the high speed engine operating condition, although the air-fuel mixture can be supplied from the auxiliary scavenge passage into the cylinder-side scavenge passage, the auxiliary scavenge passage tends to provide a large resistance to flow of the air-fuel mixture and will hardly supply a sufficient amount of the air-fuel mixture into the combustion chamber because of the presence of complicated and tortuous passage portions present in such auxiliary scavenge passage.

SUMMARY OF THE INVENTION

Accordingly, the present invention is intended to provide an improved two-cycle combustion engine with minimized blow-off phenomenon, in which the air-fuel mixture that is used as the scavenging gas is discharged to the outside without being completely burned, to thereby suppress the environmental pollution and to increase the combustion efficiency.

In order to accomplish the foregoing object, the present invention in accordance with one aspect thereof provides a two-cycle combustion engine including a scavenging path for supplying an air-fuel mixture from a crank chamber into a combustion chamber. This scavenging path has a lower end portion thereof extended to assume a position where it confronts an outer end face of a bearing (i.e., one of opposite end faces of the bearing remote from the crank chamber) for a crankshaft such that the air-fuel mixture within the crank chamber is introduced into the scavenging path through the bearing.

According to this aspect of the present invention, since the lower end portion of the scavenging path is so positioned as to confront the outer end face of the bearing for the crankshaft, the scavenging path can be simple and can have a large overall length, as compared with that employed in the prior art combustion engine. Also, since the scavenging is carried out from the crank chamber through a gap in the bearing (i.e., a gap defined between inner and outer races of the bearing for the crankshaft and left by rolling balls and a ball retainer), so-called "a rotary screen effect" brought about by rotation of the balls and the ball retainer can be exhibited as the rotation speed of the combustion engine increases and, accordingly, the air-fuel mixture containing a large amount of droplets of gasoline and oil and atomized insufficiently can be mixed and atomized satisfactorily. Because of this, the air-fuel mixture atomized satisfactorily reaches a scavenge port of the scavenging path through the ball bearing and the long scavenging path. Therefore, an abrupt injection of the enriched air-fuel mixture from the scavenge port into the combustion chamber can advantageously be suppressed, accompanied by minimization of the blow-off phenomenon in which the air-fuel mixture is discharged to the outside without being completely burned, resulting in increase of the combustion efficiency of the air-fuel mixture.

Also, since the bearing for the crankshaft has in general an extremely high precision with minimized variation of the annular gap, the scavenging performance can be stabilized advantageously. In addition, since the scavenging is carried out through the bearing, the bearing can be satisfactorily lubricated by the air-fuel mixture during the scavenging.

In a preferred embodiment, a connecting hole is defined in the crankshaft for communicating the crank chamber to the lower end portion of the scavenging path.

According to this embodiment, even though, for example, during a high speed engine operating condition, the scavenging through the bearing does not provide a sufficient amount of the air-fuel mixture, an additional air-fuel mixture can be drawn from the connecting hole formed in the crankshaft into the scavenging path. This air-fuel mixture drawn through the connecting hole is in the form of an easily combustible air-fuel mixture which has been well mixed and sufficiently atomized within the connecting hole by the action of a centrifugal force developed by the rotating crankshaft.

In another preferred embodiment, an outlet of the connecting hole opens in a direction counter to a direction towards the scavenge port of the scavenging path during a scavenging stroke in which a piston descends. This feature is effective in that since the air-fuel mixture flowing through the connecting hole will hardly flow directly towards the scavenge port, the speed of scavenging gas or the air-fuel mixture within the scavenging path can be advantageously reduced to thereby further suppress the blow-off of the air-fuel mixture.

In an embodiment of the present invention, the scavenging path includes a first scavenge passage defined adjacent an exhaust port and a second scavenge passage defined adjacent an intake port. Each of the first and second scavenge passages has a lower end portion extended to a position, where it confronts the outer end face of the bearing for the crankshaft, and communicated with the crank chamber through the bearing. The provision of two pairs of the scavenge passages is effective to allow the air-fuel mixture to be introduced into the combustion chamber from a plurality of locations adjacent the exhaust and intake ports of the combustion chamber, respectively and, therefore, the combustion chamber can be smoothly scavenged.

In a further preferred embodiment, an introducing window is defined in a portion of the second scavenge passage above the bearing so as to open to the crank chamber. According to this embodiment, the air-fuel mixture within the crank chamber can be supplied into the second scavenge passage not only through the bearing, but also through the introducing window. Accordingly, even where the scavenging through the bearing is insufficient, a sufficient amount of the air-fuel mixture can be supplied into the combustion chamber through the introducing window. In such case, since the introducing window is defined in that portion of the second scavenge passage adjacent the intake port and remote from the exhaust port, the enriched air-fuel mixture flowing into the second scavenge passage through the introducing window is hardly blown off from the exhaust port during the scavenging stroke. Also, since the principal air-fuel mixture can be sufficiently atomized as it flows through the gap in the bearing, the combustion efficiency of the air-fuel mixture increases advantageously.

In the practice of the previously described embodiment, the surface area or the opening area of the introducing window is chosen to be smaller than the cross-sectional surface area or the passage area of the second scavenge passage. This feature means that the introducing window, which defines an entrance leading towards the second scavenge passage, is throttled or constricted, and, accordingly, the blow-off which will occur as the air-fuel mixture within the crank chamber flows into the second scavenge passage through the introducing window at a high speed can advantageously be suppressed.

In a still preferred embodiment of the present invention, the scavenging path includes a first scavenge passage defined adjacent an exhaust port and a second scavenge passage defined adjacent an intake port, and one of the first and second scavenge passages has a lower end portion extended to a position, where it confronts the outer end face of the bearing for the crankshaft, and communicated with the crank chamber through the bearing. The other of the first and second scavenge passages has an introducing window defined at a lower end portion thereof above the bearing so as to open to the crank chamber. This structural feature is effective in that even when the scavenging from the bearing may be insufficient, a sufficient amount of the scavenging gas can be secured from the other of the first and second scavenge passages opening into the crank chamber.

Preferably, each of the first and second scavenge passages has a scavenge port, and the first scavenge passage has the lower end portion extended to the portion where it is held in face-to-face relation with the outer end face of the bearing for the crankshaft. In this arrangement, an uppermost edge of the scavenge port of each of the first and second scavenge passages is positioned at a level lower than that of the exhaust port and the uppermost edge of the scavenge port of the first scavenge passage is positioned at a level somewhat higher than that of the scavenge port of the second scavenge passage.

According to this preferred arrangement, the relatively lean air-fuel mixture can be introduced into the first scavenge passage from a location in the vicinity of the bearing by the action of a centrifugal force developed by the crankshaft and is then injected into the combustion chamber from a location adjacent the exhaust port. However, since the air-fuel mixture so introduced is lean, it will not adversely pollute the environment even though the air-fuel mixture blows off from the exhaust port.

On the other hand, the relatively enriched air-fuel mixture can be introduced into the second scavenge passage through the above described introducing window by the action of a centrifugal force developed by the crankshaft. However, since this relatively enriched air-fuel mixture is subsequently injected into the combustion chamber through the scavenge port adjacent the intake port, but distant from the exhaust port, and at a timing delayed relative to the flow of the air-fuel mixture through the first scavenge passage, the enriched air-fuel mixture can be blocked by the air-fuel mixture from the first scavenge passage and will not therefore blow off from the exhaust port to the outside.

The present invention in accordance with another aspect thereof provides a two-cycle combustion engine, which includes a scavenging path for supplying an air-fuel mixture from a crank chamber into a combustion chamber, the scavenging path having a scavenge inlet opening in the crank chamber at a lower end and also having a portion adjacent the lower end formed with a scavenging chamber in face-to-face relation with the scavenge inlet and protruding radially outwardly from the scavenging path for introducing the air-fuel mixture through the scavenge inlet towards the scavenging chamber.

According to this aspect of the present invention, since the air-fuel mixture within the crank chamber flows into the scavenging chamber prior to flow into the combustion chamber, the scavenging gas speed can be lowered. Because of this, an abrupt injection of the air-fuel mixture from the scavenge port into the combustion chamber can be advantageously prevented to thereby reduce the blow-off of the air-fuel mixture to the outside, i.e., the atmosphere. Also, during an intake stroke, the insufficiently atomized air-fuel mixture which is introduced into the crank chamber flows into the scavenging chamber through the scavenge inlet and is then mixed in the scavenging chamber to facilitate atomization of the air-fuel mixture to thereby provide an easily combustible air-fuel mixture. Since this easily combustible air-fuel mixture is subsequently supplied into the combustion chamber through main portions of the scavenging path, the blow-off of unburned components in the form of oil droplets can be advantageously suppressed and, at the same time, the combustion efficiency can also be increased.

The scavenging path may include a first scavenge passage defined adjacent an exhaust port and a second scavenge passage defined adjacent an intake port. In this case, an introducing window open towards the crank chamber and having a surface area or an opening area smaller than a cross-sectional surface area of the second scavenge passage is defined in a portion of the second scavenge passage above the scavenging chamber. This feature is particularly advantageous in that since the relatively enriched air-fuel mixture present in a portion of the crank chamber distant from the crankshaft can be introduced into the second scavenge passage through this introducing window, the scavenging gas amount required to achieve a high engine output can easily be obtained. Also, since the introducing window in that portion of the second scavenge passage is throttled or constricted.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described in detail with reference to the accompanying drawings.

Figure 1:
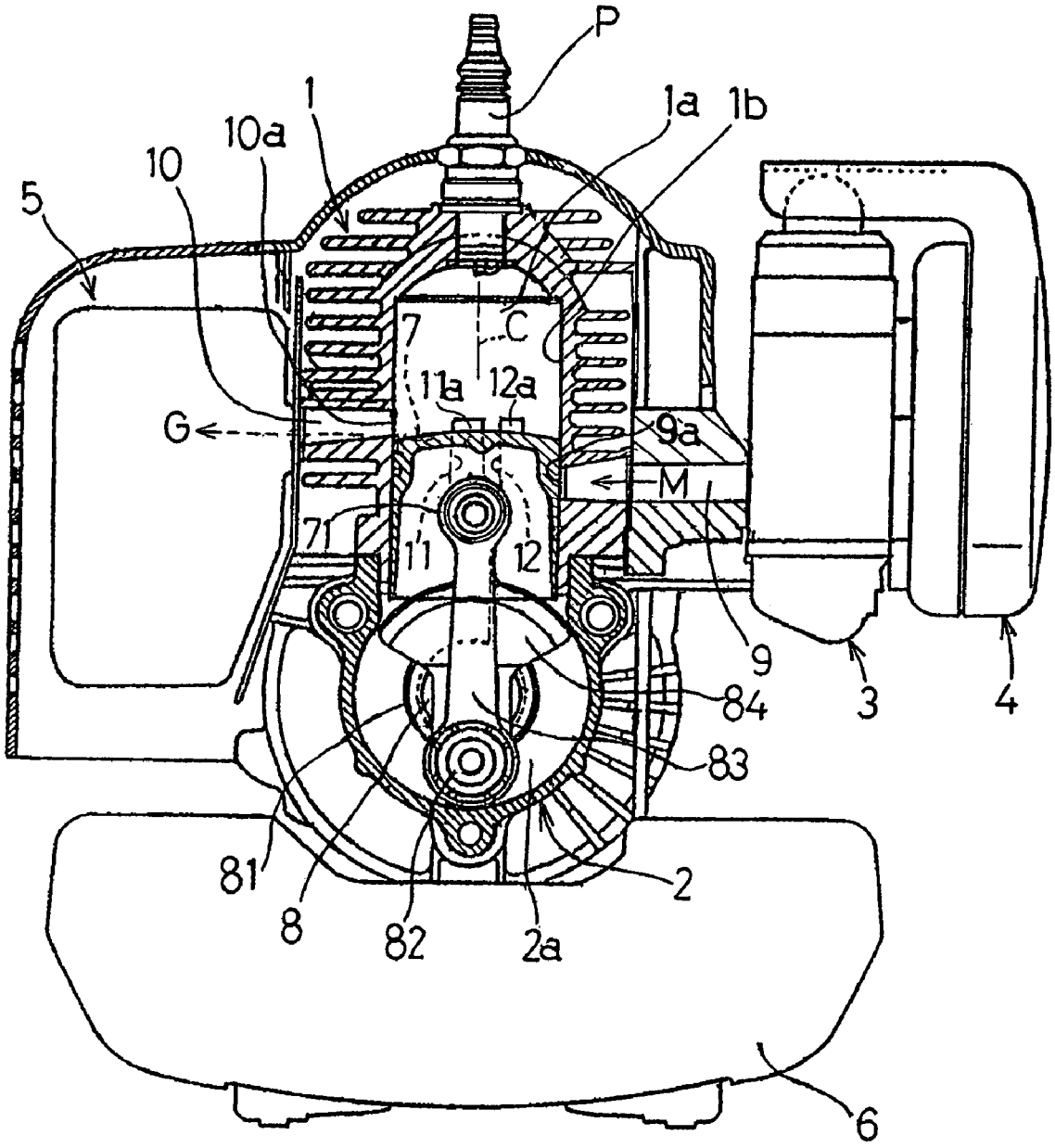
FIG. 1 is a transverse sectional view of a two-cycle internal combustion engine according to a first preferred embodiment of the present invention.

Referring first to FIG. 1, the two-cycle internal combustion engine shown therein in accordance with a first preferred embodiment of the present invention includes a cylinder block 1 having a cylinder bore 1*b* defined therein and an ignition plug P mounted atop the cylinder block 1, and a crankcase 2 having a crank chamber 2*a* defined therein with the cylinder block 1 being fixedly mounted thereon. A carburetor 3 and an air cleaner unit 4, forming respective parts of an air intake system of the two-cycle internal combustion engine are fluid connected with a side wall portion, for example, a right side wall portion of the cylinder block 1 while a muffler 5 forming a part of an exhaust system of the same engine is fluid connected with a left side wall portion of the cylinder block 1. A fuel tank 6 is secured to a bottom portion of the crankcase 2. The cylinder bore 1*b* in the cylinder block 1 accommodates therein a piston 7 for reciprocating movement in a direction axially thereof, which piston 7 cooperates with the cylinder bore 1*b* to define a capacity-variable combustion chamber 1*a*. The cylinder bore 1*b* is communicated with the crank chamber 2*a*.

A crankshaft 8 driven by the piston 7 is rotatably supported within the crankcase 2 by crankshaft bearings 81. The bearing 81 may be a ball bearing having an annular gap 81*a* (FIG. 4) between inner and outer races. The crankshaft 8 also includes a pair of crank webs 84 (FIG. 4) so as to lie generally perpendicular to the longitudinal axis of the crankshaft 8. The webs 84, 84 are connected by a hollow crankpin 82 positioned at a location offset radially from the longitudinal axis of the crankshaft 8, and the piston 7 is provided with a hollow piston pin 71. The crankpin 82 end the piston pin 71 are connected by a connecting rod 83.

An intake passage 9 having an intake port 9*a* defined at one end thereof is formed in a side wall portion, for example, a right side wall portion as viewed in FIG. 1, of the cylinder block 1 with the intake port 9*a* opening in the cylinder bore of the cylinder block 1 and is fluid connected at the opposite end thereof with the carburetor 3 so that an air-fuel mixture M can be supplied into the crank chamber 2*a* through the intake port 9*a*. On the other hand, an exhaust passage 10 having an exhaust port 10*a* defined at one end thereof is formed in another side wall portion, for example, a left side wall portion as viewed in FIG. 1, of the cylinder block 1 with the exhaust port 10*a* opening at the inner peripheral surface of the cylinder block 1 so that exhaust gases (burned gases) generated within the combustion chamber 1*a* can be exhausted to the outside through this exhaust passage 10 by way of the exhaust port 10*a* and then through a muffler 5.

Figure 2:
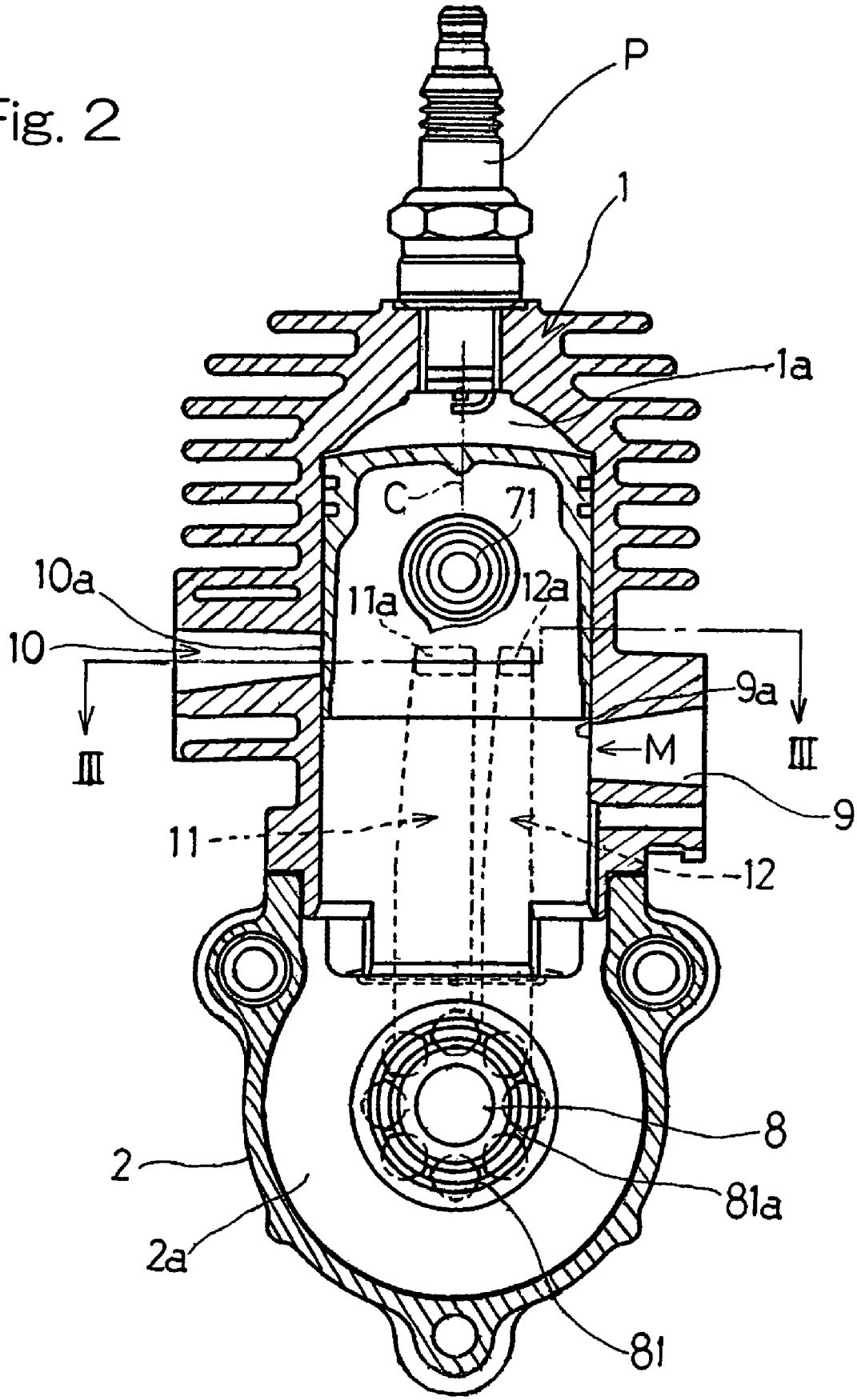
FIG. 2 is a transverse sectional view, on an enlarged scale, of the two-cycle internal combustion engine, showing a cylinder block and a crankcase.
Figure 3:
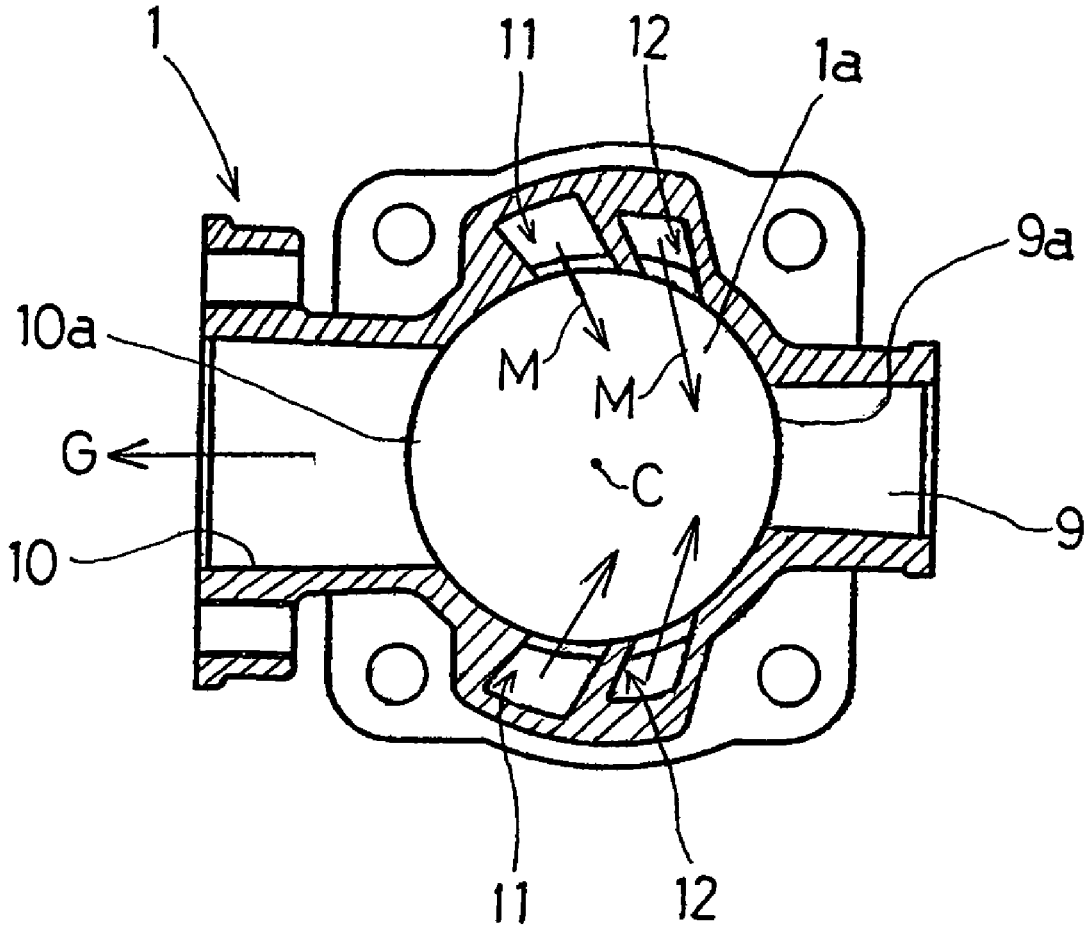
FIG. 3 is a cross-sectional view taken along the line III—III in FIG. 2.

As shown in FIG. 2, first and second scavenge passages 11 and 12 for the supply of the air-fuel mixture M from the crank chamber 2*a* into the combustion chamber 1*a* are formed in part in the cylinder block 1 and in part in the crankcase 2. The first and second scavenge passages 11 and 12 extends in a direction substantially parallel to the longitudinal axis C of the cylinder block 1 and are, as shown in FIG. 3, employed in two pairs with each pair being circumferentially opposed to each other.

It is to be noted that although the first and second scavenge passages 11 and 12 are employed in two pairs in the illustrated embodiment, the two-cycle internal combustion engine of the present invention may include only one pair of scavenge passages.

The first scavenge passage 11 has a cross-sectional surface area or path area chosen to be larger than that of the second scavenge passage 12. The first and second scavenge passages 11 and 12 are spaced a distance from each other in a direction circumferentially of the combustion engine and are positioned adjacent to the exhaust port 10*a* and the intake port 9*a*, respectively.

Figure 4:
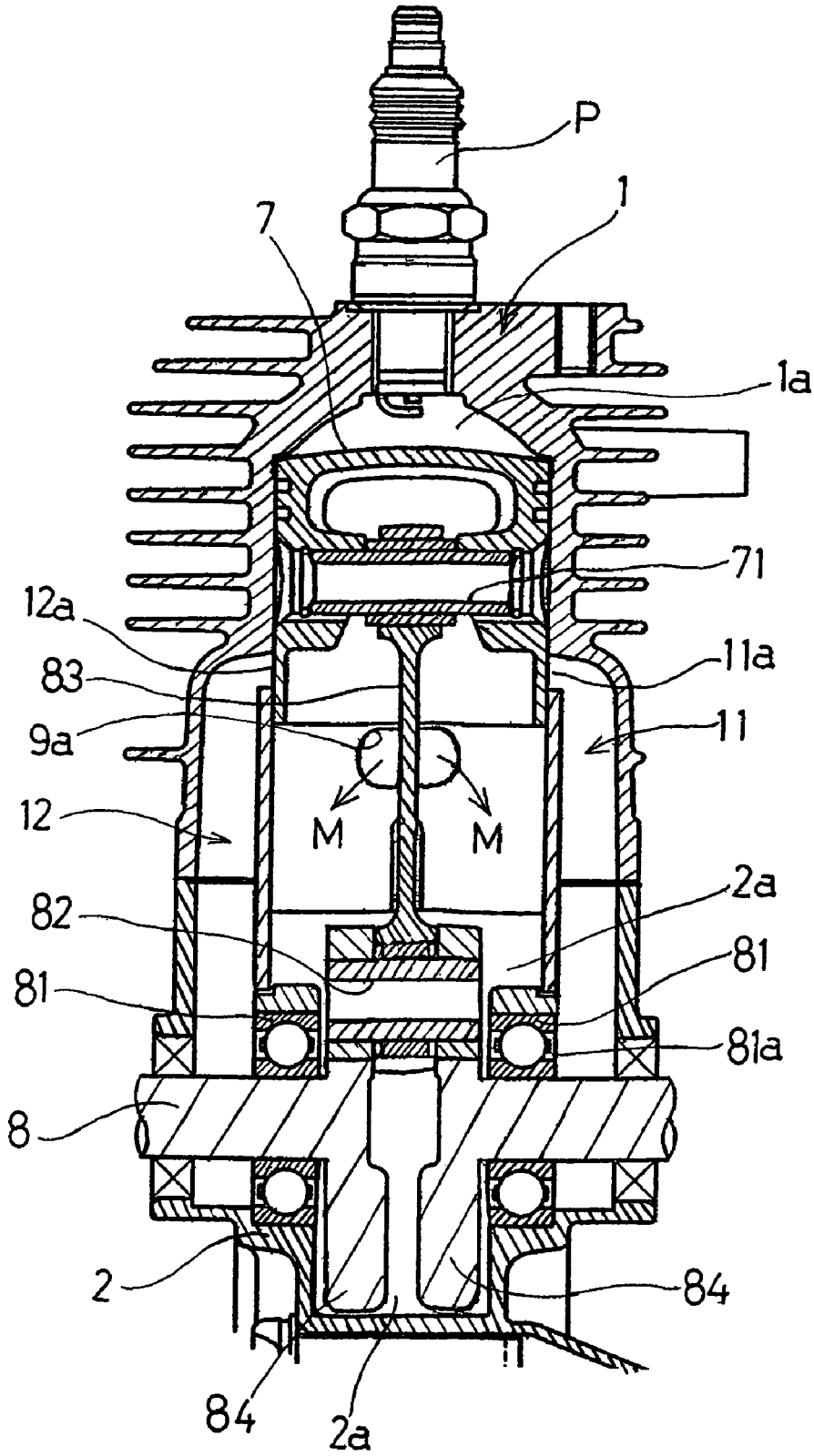
FIG. 4 is a longitudinal sectional view of the two-cycle internal combustion engine, showing the details of first and second scavenge passages during the intake stroke.

As best shown in FIG. 4, the first and second scavenge passages 11 and 12 have respective lower ends extending downwardly in the wall of the crankcase 2 and terminating substantially at a location facing an outer end face, or an end face opposite to the crank chamber 2*a*, of the associated crankshaft bearing 81 so as to communicate with the crank chamber 2*a* through the annular gap 81*a* in the crankshaft bearing 81 that is defined between inner and outer races of the crankshaft bearing 81 and left by rolling balls and a ball retainer both situated between the inner and outer races.

On the other hand, the first and second scavenge passages 11 and 12 have respective upper ends extending upwardly in the wall of the cylinder block 1 and having first and second scavenge ports 11*a* and 12*a* open at the inner peripheral surface of the cylinder block 1 in communication with the combustion chamber 1*a*.

As clearly shown in FIG. 1, the first and second scavenge ports 11*a* and 12*a* are so defined and so positioned relative to the exhaust port 10*a* that the topmost edge portion of each of the first and second scavenge ports !11*a* and 12*a* can be held at a level lower than the topmost edge portion of the exhaust port 10*a*. Further the uppermost edge of the scavenge port 11*a* of the first scavenge passage 11 is positioned at a level somewhat higher than that of the scavenge port 12*a* of the second scavenge passage 12. It is to be noted that in FIG. 4, the first and second scavenge passages 11 and 12, which in reality are not circumferentially opposed (180° displaced) to each other, are exaggeratedly shown as circumferentially opposed to each other for the sake of better understanding.

The operation of the two-cycle internal combustion engine of the structure described hereinbefore will now be described.

Referring to FIG. 1, when as a result of an ascending motion of the piston 7 from the bottom dead center towards the top dead center within the cylinder block 1 the first and second scavenge ports 11*a* and 12*a*, which provide a passage of supply of the air-fuel mixture M into the combustion chamber 1*a*, are closed by the piston 7, the combustion engine assumes a compression stroke in which the air-fuel mixture M within the combustion chamber 1*a* is compressed. Further ascending motion of the piston 7 results in increase of the capacity of the crank chamber 2*a* by a quantity corresponding to the distance over which the piston 7 has ascended, with a negative pressure consequently developed within the crank chamber 2*a*. When in this condition the intake port 9*a* starts opening, the combustion engine assumes an intake stroke in which the air-fuel mixture M is sucked from the intake port 9*a* directly into the crank chamber 2*a*. The air-fuel mixture M then introduced into the crank chamber 2*a* contains a large amount of liquid droplets such as those of gasoline and oil and cannot necessarily be regarded as sufficiently atomized.

As the piston 7 moving upwardly nears to the top dead center as shown in FIG. 4, the air-fuel mixture M then compressed within the combustion chamber 1*a* is ignited by the ignition plug P and is hence burned, producing a high pressure within the combustion chamber 1*a*. By the action of this high pressure of the burned gases G, the piston 7 having arrived at the top dead center is urged downwardly so as to travel towards the bottom dead center. As the piston 7 descends this way, the exhaust port 10*a* defined in the inner peripheral surface of the cylinder block 1 opens and the burned gases G within the combustion chamber 1*a* are then exhausted as exhaust gases to the atmosphere through the exhaust passage 10 by way of the muffler 5. Further descending motion of the piston 7 results in decrease of the capacity of the crank chamber 2*a* to allow the air-fuel mixture M having been introduced into the crank chamber 2*a* to be compressed.

Figure 5:
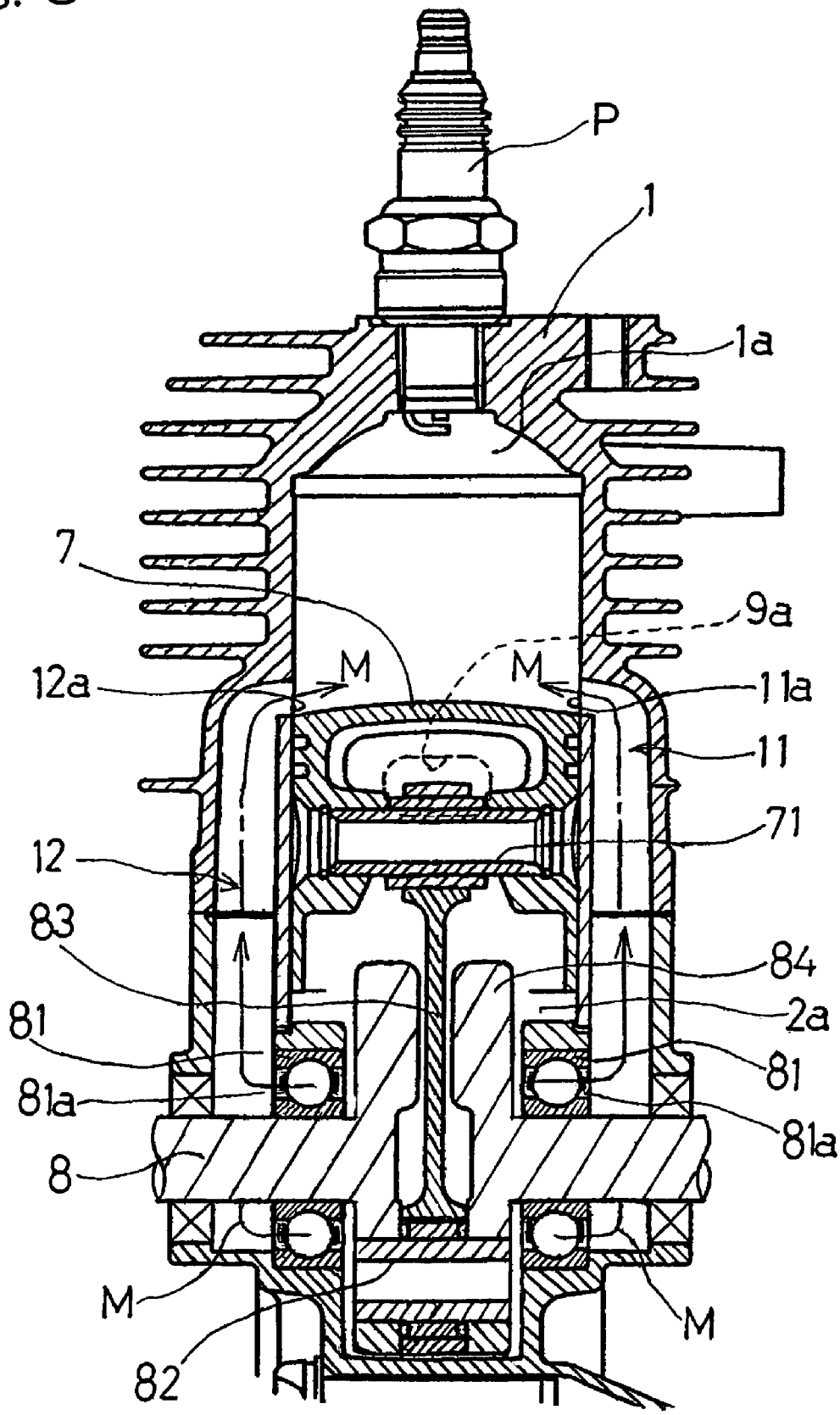
FIG. 5 is a longitudinal sectional view of the two-cycle internal combustion engine, showing the first and second scavenge passages during the scavenge stroke.

During the scavenging stroke shown in FIG. 5, when the piston 7 then descending nears the bottom dead center, the first and second scavenge ports 11*a* and 12*a* are opened to allow the air-fuel mixture M, compressed within the crank chamber 2*a*, to be introduced into the first and second scavenge passages 11 and 12, which are provided for primary and auxiliary scavenging purposes, respectively, through the annular gaps 81*a* in the respective bearings 81 for the crankshaft 8, finally entering the combustion chamber 1*a* through the first and second scavenge ports 11*a* and 12*a*. The air-fuel mixture M then entering the combustion chamber 1*a* acts to drive the burned gases G, that is, the exhaust gases remaining within the combustion chamber 1*a*, off from the combustion chamber 1*a* and into the exhaust passage 10 through the exhaust port 11*a*. Considering that the first and second scavenge passages 11 and 12 are positioned adjacent to the exhaust port 10*a* and the intake port 9*a*, respectively, as hereinbefore described, the combustion chamber 1*a* in its entirety can be smoothly scavenged.

Because, as hereinbefore described, each of the first and second scavenge passages 11 and 12 is long enough to have the corresponding lower end extending down to the position where it confronts the outer end face of the associated bearing 81 for the crankshaft 8, during the scavenging stroke discussed above an abrupt injection of the air-fuel mixture M compressed within the crank chamber 2*a* into the combustion chamber 1*a* from the scavenge port 11*a* which would be likely to occur when the combustion engine attains a high speed rotation can advantageously be avoided to thereby suppress the blow-off phenomenon discussed hereinbefore. Also, because each of the first and second scavenge passages 11 and 12 can be formed to extend straight, the flow resistance of the air-fuel mixture within the respective scavenge passage 11 and 12 is so low as to enable a sufficient quantity of a scavenging gas to be supplied into the combustion chamber 1*a*.

Considering that since each of the crankshaft bearings 81 is in general manufactured with extremely high precision, variation of the annular gaps 81*a* is minimal, the scavenging gas flowing through the annular gap 81*a* contributes to stabilization of the scavenging performance.

Also, since the speed of rotation of the balls and the ball retainer both forming respective parts of each of the crankshaft bearings 81 increases with increase of the rotation speed of the combustion engine, a rotary screen effect can be brought about to thereby facilitate mixing and atomization of the air-fuel mixture component and the oil component that are introduced from the crank chamber 2*a*. This in turn brings about the sufficiently atomized air-fuel mixture M being supplied as the scavenging gas.

Yet, the scavenging speed can be lowered by the bearings and an abrupt injection of the air-fuel mixture from the scavenging port into the combustion chamber can advantageously be suppressed. Moreover, the oil component, or a fuel component, contained in the air-fuel mixture M flowing into the first and second scavenge passages 11 and 12 through the annular gaps 81*a* (defined between inner and outer races of the crankshaft bearing 81 and left by the rolling balls and the ball retainer) in the crankshaft bearings 81 can be effectively and efficiently utilized to sufficiently lubricate the crankshaft bearings 81.

Figure 6:
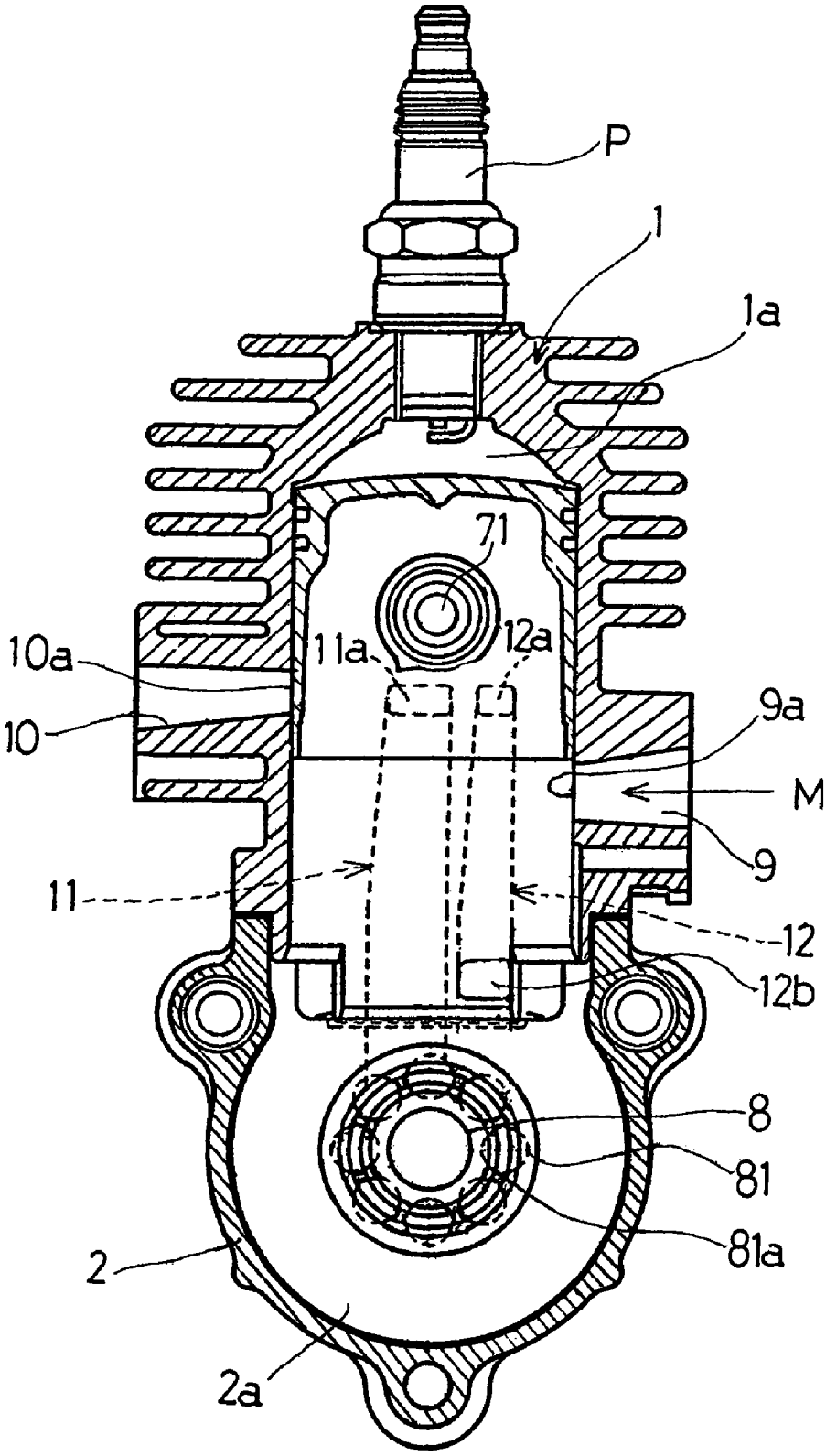
FIG. 6 is a transverse sectional view of a two-cycle internal combustion engine according to a second preferred embodiment of the present invention.

Referring now to FIG. 6, there is shown the two-cycle internal combustion engine according to a second preferred embodiment of the present invention. In this embodiment, the second scavenge passage 12 for auxiliary scavenging purpose has its lower end which opens as an introducing window 12*b* in communication with the crank chamber 2*a* at a location above the associated crankshaft bearing 81, rather than extending down to the position where it confronts the outer end face of the associated bearing 81 for the crankshaft 8. According to this embodiment, even though the amount of the scavenging gas fed through the associated crankshaft bearing 81 is insufficient, the air-fuel mixture M can be introduced into the second scavenging passage 12 from the port 12*b* that opens towards the crank chamber 2*a*, and, therefore, a sufficient amount of the scavenging gas can be secured.

Also, a relatively lean air-fuel mixture M can be introduced into the first scavenge passage 11 from a position in the vicinity of the associated crankshaft bearing 81 by the action of a centrifugal force developed by the crankshaft 8 and is subsequently jetted into the combustion chamber 1*a* from the first scavenge port 11*a* adjacent the exhaust port 10*a*. However, since the air-fuel mixture M so introduced is lean, a blow-off of such lean air-fuel mixture M from the exhaust port 10*a*, if it occurs, will little affect the environment adversely.

On the other hand, a relatively enriched air-fuel mixture M is introduced into the second scavenge passage 12 from the port 12*b* in the lower end of the second scavenge passage 12 by the action of the centrifugal force developed by the crankshaft 8. However, since this enriched air-fuel mixture M is jetted into the combustion chamber 1*a* from the second scavenge port 12*a* adjacent the intake port 8*a*, which is distant from the exhaust port 10*a*, and at a timing delayed relative to the jetting of the lean air-fuel mixture M from the first scavenge passage 11 into the combustion chamber 1*a*, the enriched air-fuel mixture M from the second scavenge passage 12 can be blocked by the lean air-fuel mixture M from the first scavenge passage 11, to thereby suppress the blow-off phenomenon of the enriched air-fuel mixture M from the exhaust port 10*a*.

It is, however, to be noted that contrary to the foregoing, the first scavenge passage 11 may have its lower end which opens in communication with the crank chamber 2*a* at a location above the associated crankshaft bearing 81, while the lower end of the second scavenge passage 12 extends down to the position where it confronts the outer end face of the associated crankshaft bearing 81. Even in this alternative case, a sufficient amount of the scavenging gas can be secured since the air-fuel mixture M can be introduced into the first scavenge passage 11 through the opening so communicated with the crank chamber 2*a* as described above.

Figure 7:
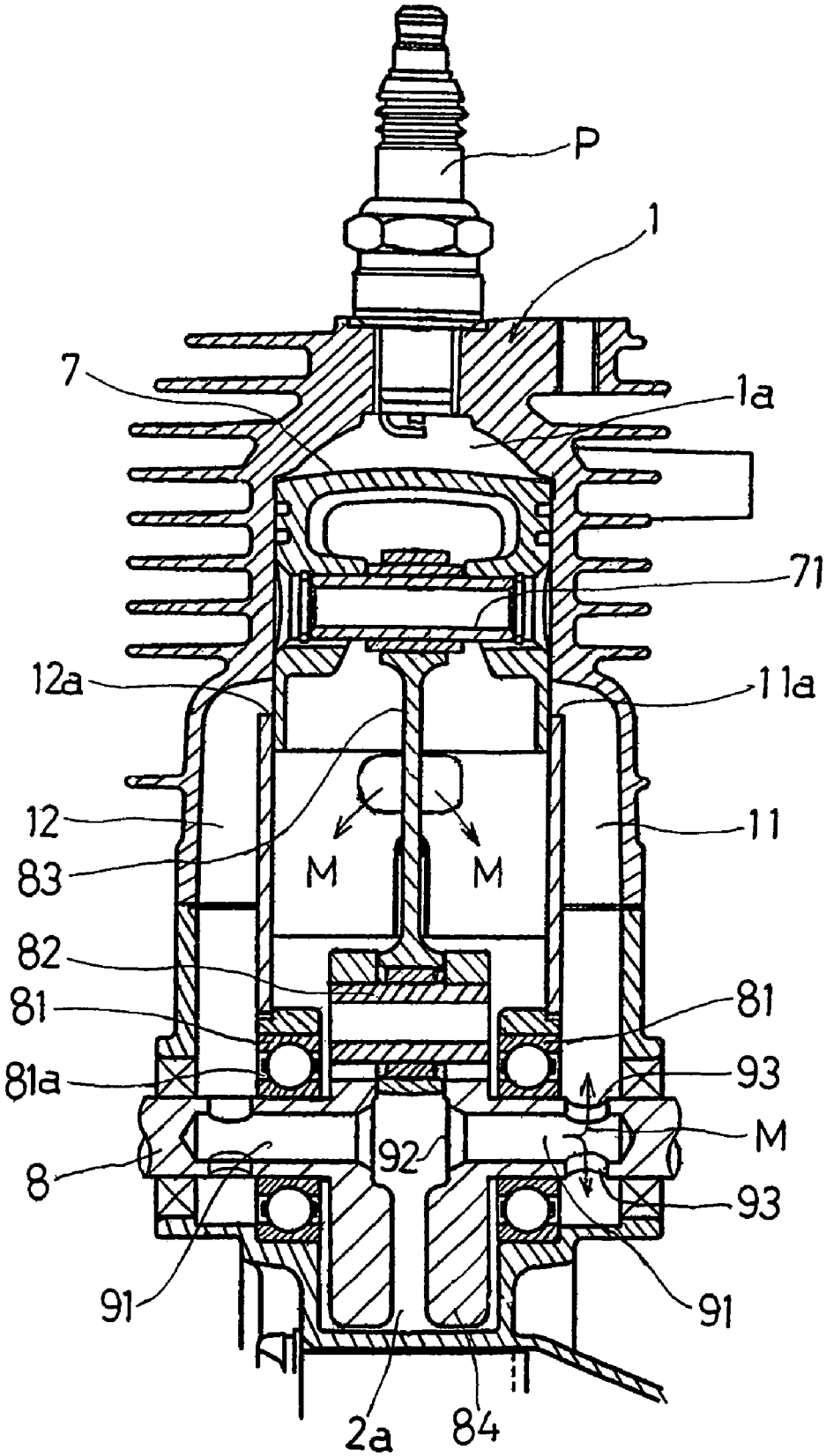
FIG. 7 is a longitudinal sectional view of a two-cycle internal combustion engine according to a third preferred embodiment of the present invention.

FIG. 7 illustrates a third preferred embodiment of the present invention. Where the scavenging with the gas fed through the crankshaft bearing 81 does not supply a sufficient amount of the air-fuel mixture into the combustion chamber la during a high speed operation of the combustion engine, coaxial connecting holes 91 for communicating between the crank chamber 2*a* and the first and second scavenge passages 11 and 12 may be formed in the crankshaft 8 so as to extend concentrically therewith as shown in FIG. 7. With this construction, the air-fuel mixture M within the crank chamber 2*a* can be drawn into the first and second scavenge passages 11 and 12 from a space in the crank chamber between the paired crank webs 84 by way of the connecting holes 91 to thereby supplement the air-fuel mixture in the scavenge passages 11 and 12. In such embodiment, the air-fuel mixture M drawn into the connecting holes 91 through inlets 92 defined at web end faces of the crankshaft 8 can be effectively mixed by the centrifugal force developed as a result of rotation of the crankshaft 8 and, therefore, the sufficiently atomized air-fuel mixture M can be supplied into the first and second scavenge passages 11 and 12 through outlets 93 defined in a peripheral wall of the crankshaft 8. Accordingly, even if the amount of the scavenging gas from the crankshaft bearing 81 is insufficient, the scavenging gas can be sufficiently supplemented with the air-fuel mixture so supplied through the outlets 93 in the crankshaft 8.

It is to be noted that so far shown in FIG. 7, two outlets 93 are defined for each of the connecting holes 91 and, hence, in the peripheral wall of each of left and right portions of the crankshaft 8.

Figure 8:
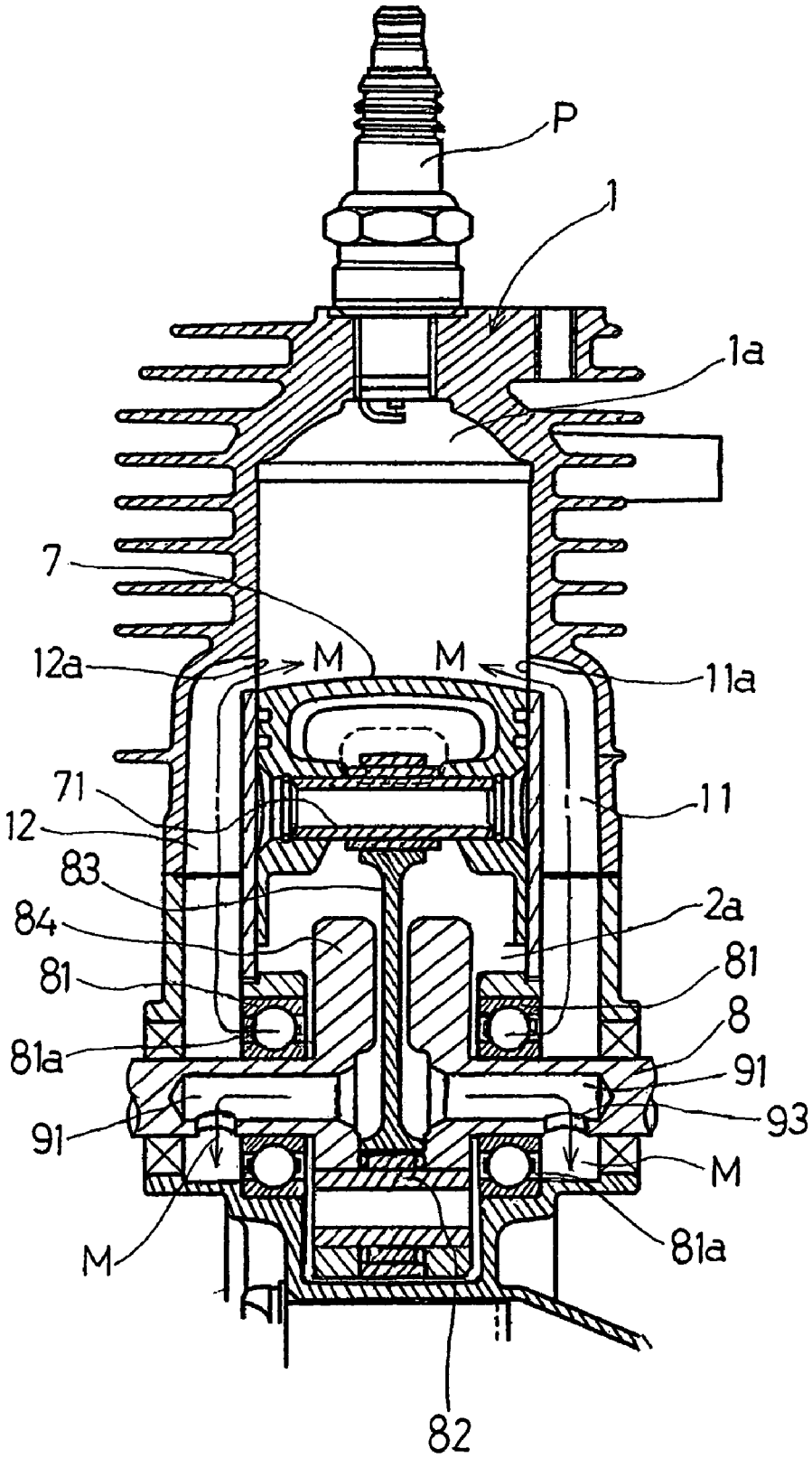
FIG. 8 is a longitudinal sectional view of a modified form of the two-cycle internal combustion engine according to the third preferred embodiment of the present invention.

In a modified form of the third preferred embodiment of the present invention shown in FIG. 8, the two-cycle combustion engine is so designed that during the scavenging stroke in which the piston 7 descends, the outlets 93 defined in the peripheral wall of the crankshaft 8 in communication with the respective connecting holes 91 can be oriented downwards, that is, in a direction counter to the direction towards the first and second scavenge ports 11*a* and 12*a*. According to this embodiment shown in FIG. 8, the air-fuel mixture M flowing through the connecting holes 91 will find a way difficult to flow directly towards the first and second scavenge ports 11*a* and 12*a* so that the speed of flow of the scavenging gases within the first and second scavenge passages 11 and 12 can be lowered to thereby further suppress the blow-off phenomenon.

Figure 9:
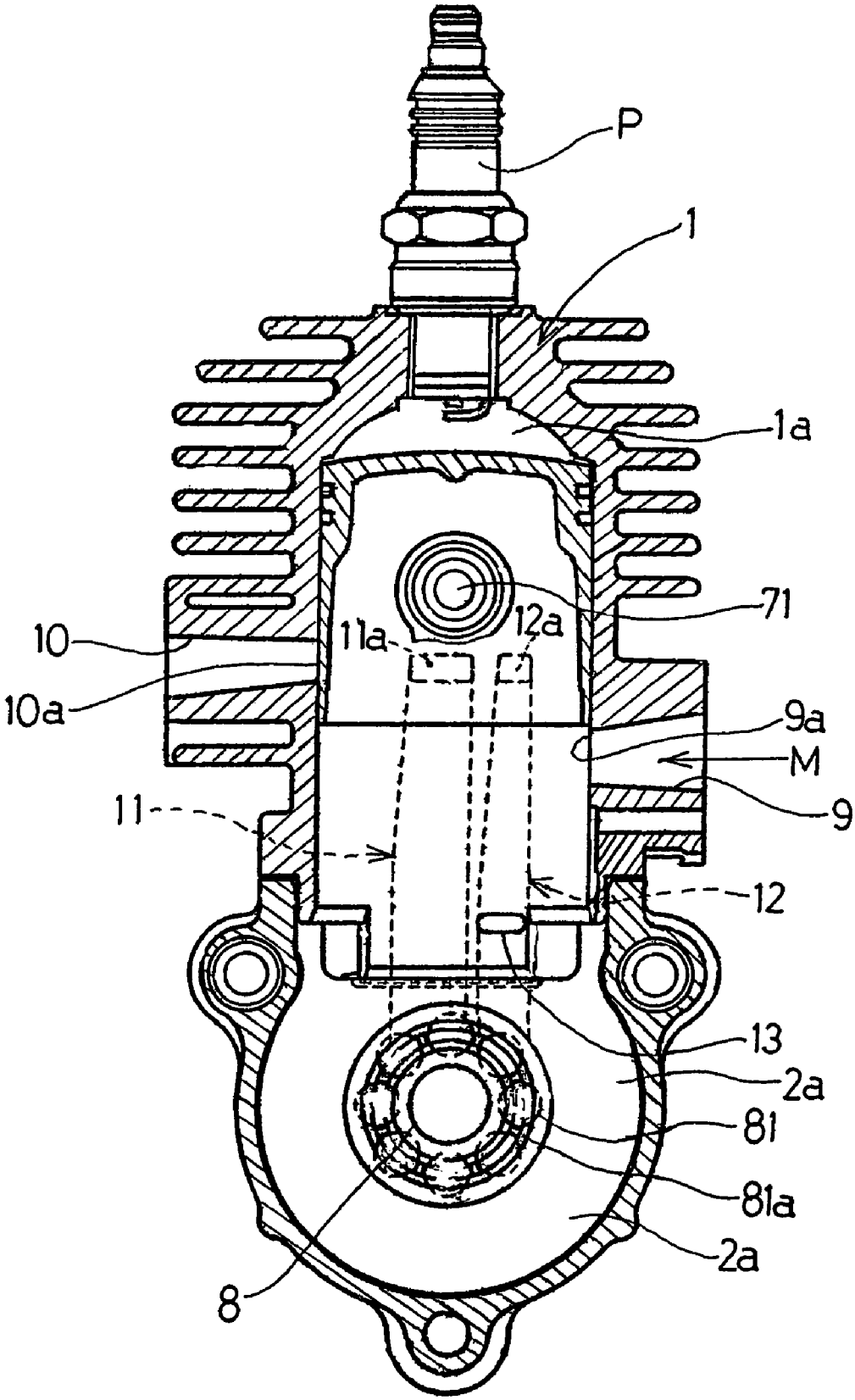
FIG. 9 is a transverse sectional view of a two-cycle internal combustion engine according to a fourth preferred embodiment of the present invention.
Figure 10:
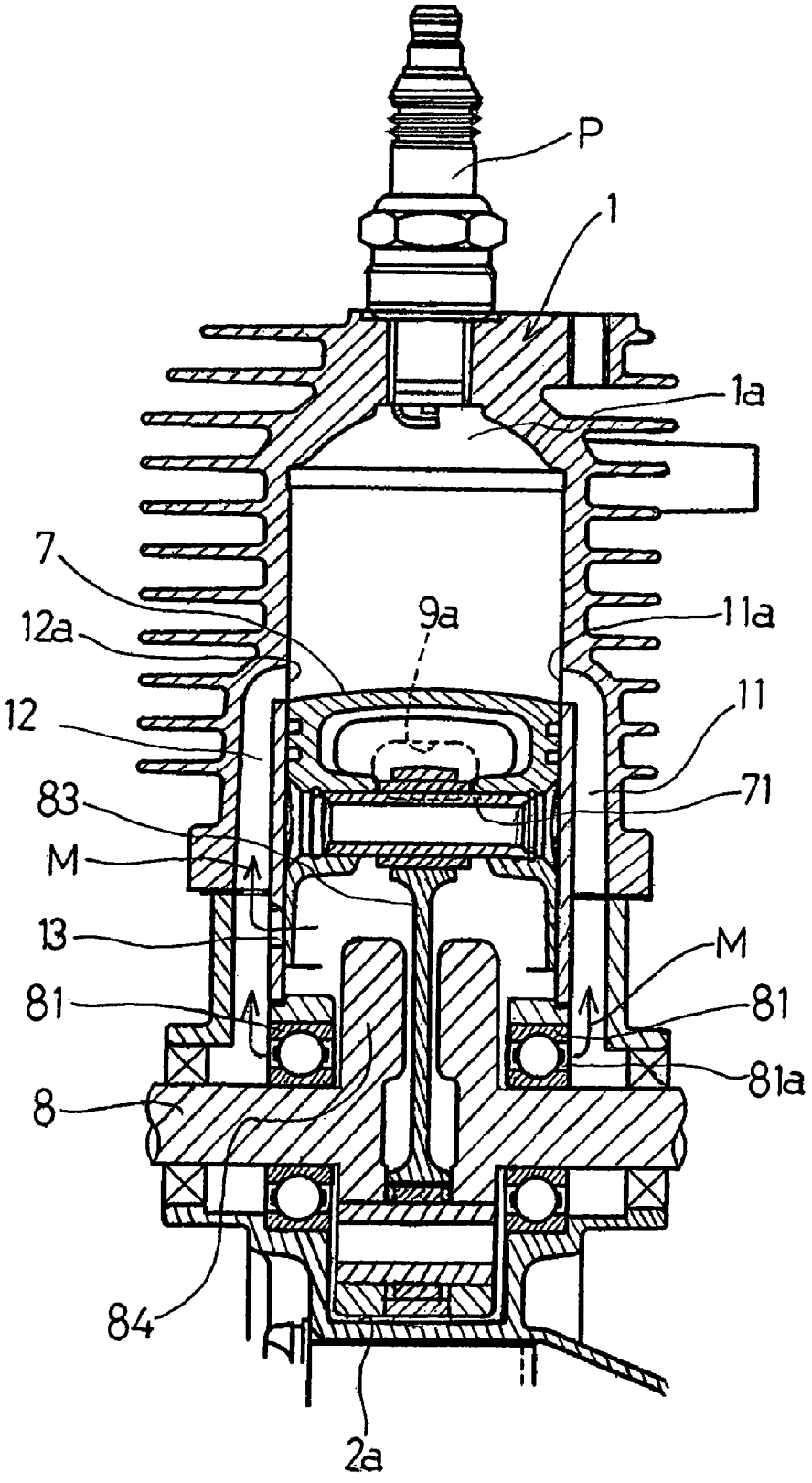
FIG. 10 is a longitudinal sectional view of the two-cycle internal combustion engine shown in FIG. 9, showing the details of the first and second scavenge passages.

Referring now to FIGS. 9 and 10, the two-cycle internal combustion engine according to a fourth preferred embodiment of the present invention will now be described.

The two-cycle internal combustion engine according to this embodiment is similar to that shown in and described with reference to FIG. 7 in connection with the third embodiment of the present invention, except that in place of the connecting holes 91 formed in the crankshaft 8 shown in FIG. 7, an introducing window 13 communicated with the crank chamber 2*a* shown in FIG. 9 is formed at a portion of the second scavenge passage 12 adjacent the intake port 9*a* above the crankshaft bearings 81. The introducing window 13 has a surface area or an opening area chosen to be smaller than the cross-sectional area of the second scavenge passage 12 so that the air-fuel mixture M entering therethrough from the crank chamber 2*a* can be throttled to thereby avoid a high speed flow thereof into the second scavenge passage 12.

According to the fourth embodiment of the present invention, as shown in FIG. 10, during the scavenging stroke in which the piston 7 descends, in a manner similar to that in the first embodiment of the present invention shown in and described with reference to FIGS. 1 to 5, the air-fuel mixture M within the crank chamber 2*a* shown in FIG. 10 is introduced into the first and second scavenge passages 11 and 12 through the annular gaps 81*a* in the bearings 81 for the crankshaft 8. At this time, not only can the bearings 81 be lubricated with the oil component or the fuel component contained in the air-fuel mixture M, but a favorable atomized condition can also be obtained. Further, the air-fuel mixture M then rendered to be lean by the action of the centrifugal force developed by the crankshaft 8 can be introduced into the combustion chamber 1*a* from the scavenge port 11*a* by way of the first scavenge passage 11. Since the second scavenge passage 12 is provided with the introducing window 13 open particularly towards the crank chamber 2*a*, in addition to the lean air-fuel mixture M being introduced into the second scavenge passage 12 through the annular gaps 81*a* in the bearings 81, the enriched air-fuel mixture M within the crank chamber 2*a* can be introduced into the second scavenge passage 12 through the introducing window 13 and then into the combustion chamber 1*a* through the second scavenge passage 12.

As discussed above, even where the sole supply of the air-fuel mixture M as the scavenging gas into the combustion chamber 1*a* through the first and second scavenge passages 11 and 12 by way of the bearings 81 would result in an insufficient output of the combustion engine, the supply of the air-fuel mixture M, introduced into the second scavenge passage 12 through the introducing window 13, into the combustion chamber 1*a* ensures a sufficient amount of the scavenging gas even during a high output engine operating condition. In such case, as described previously in connection with the second embodiment of the present invention shown in FIG. 6, the relatively enriched air-fuel mixture can be advantageously supplied through the introducing window 13. In addition, since the second scavenge passage 12 shown in FIG. 9 is formed at a location adjacent the intake port 9*a* and remote from the exhaust port 10*a* as compared with the first scavenge passage 11, the blow-off of the enriched air-fuel mixture M will hardly occur.

Figure 11:
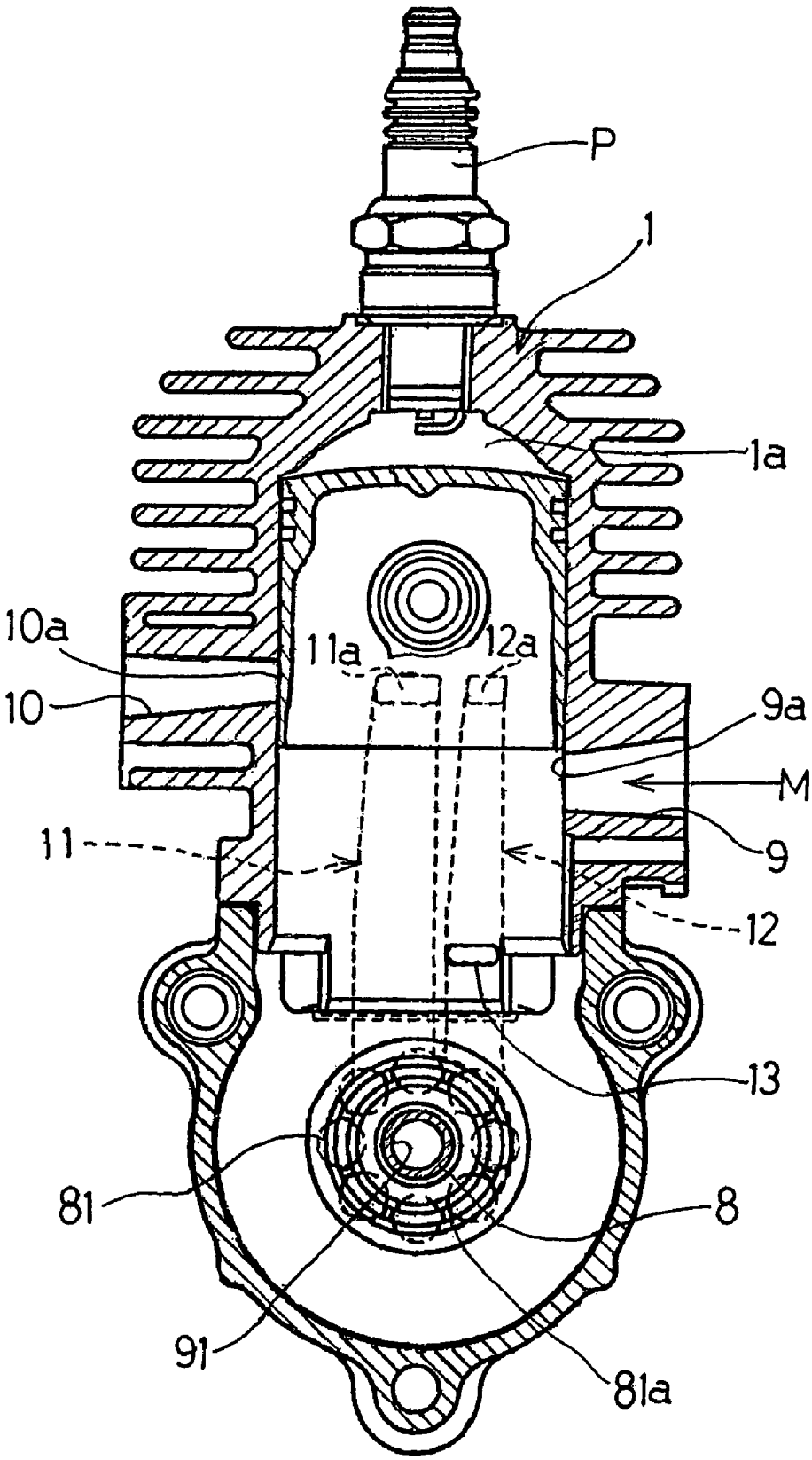
FIG. 11 is a transverse sectional view of a two-cycle internal combustion engine according to a fifth preferred embodiment of the present invention.
Figure 12:
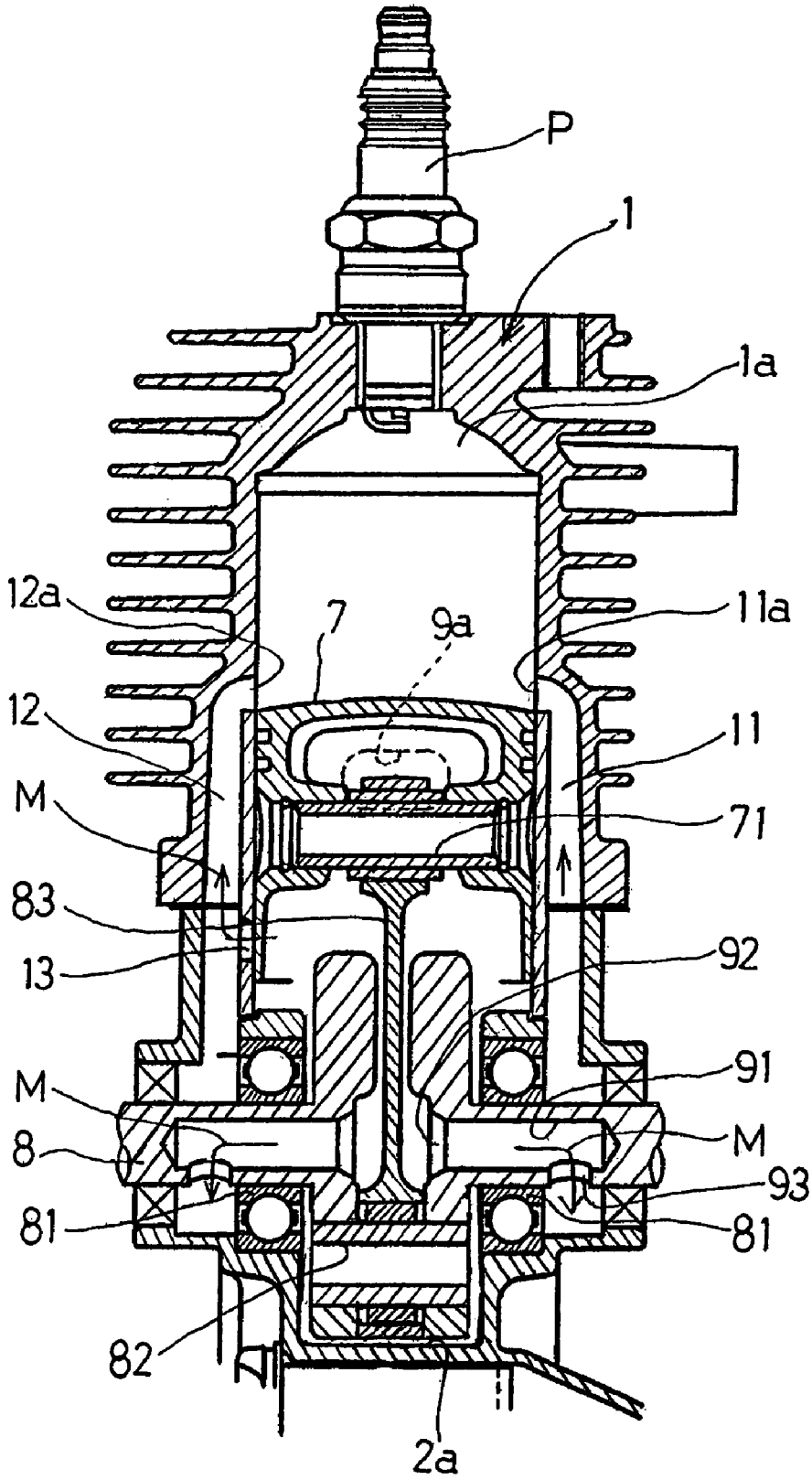
FIG. 12 is a longitudinal sectional view of the two-cycle internal combustion engine shown in FIG. 11, showing the details of the first and second scavenge passages.

FIGS. 11 and 12 illustrate the two-cycle internal combustion engine according to a fifth preferred embodiment of the present invention.

In this embodiment, each of the first and second scavenge passages 11 and 12 has its lower end extending down to the position where it confronts the outer end face of the associated bearing 81 for the crankshaft 8. In addition to introduction of the air-fuel mixture M through the annular gaps in the bearings 81 for the crankshaft 8 and the connecting holes 91 defined in the crankshaft 8, the air-fuel mixture M is also introduced through the introducing window 13 that is defined at a location above the bearing 81. As best shown in FIG. 12, the outlets 93 of the connecting holes 91 in the crankshaft 8 are so positioned as to be oriented downwardly during the scavenging stroke in which the piston 7 descends and, accordingly, the air-fuel mixture M flowing outwardly from the connecting holes 91 does hardly flow directly towards the first and second scavenge ports 11*a* and 12*a*. Accordingly, in addition to the relatively lean air-fuel mixture M flowing outwardly not only from the annular gaps 81*a* of the crankshaft bearings 81, but also from the connecting holes 91 defined in the crankshaft 8, a sufficient amount of the scavenging gas can be secured by the enriched air-fuel mixture M introduced from the introducing window 13.

In a sixth preferred embodiment shown in FIGS. 13 to 16, the two-cycle internal combustion engine shown therein is similar to that according to the first embodiment, except that in the sixth embodiment a scavenging chamber 14 which opens towards the crank chamber 2*a* is defined to connect with the first and second scavenge passages 11 and 12 above the bearings 81 for the crankshaft 8, while the lower end portions of the first and second scavenge passages 11 and 12 do not have respective lower ends extended down to confront the outer end faces of the bearings 81 but have, at the lower ends, scavenge inlets 15 opening in the crank chamber 14, or a lower portion of cylinder bore.

Figure 13:
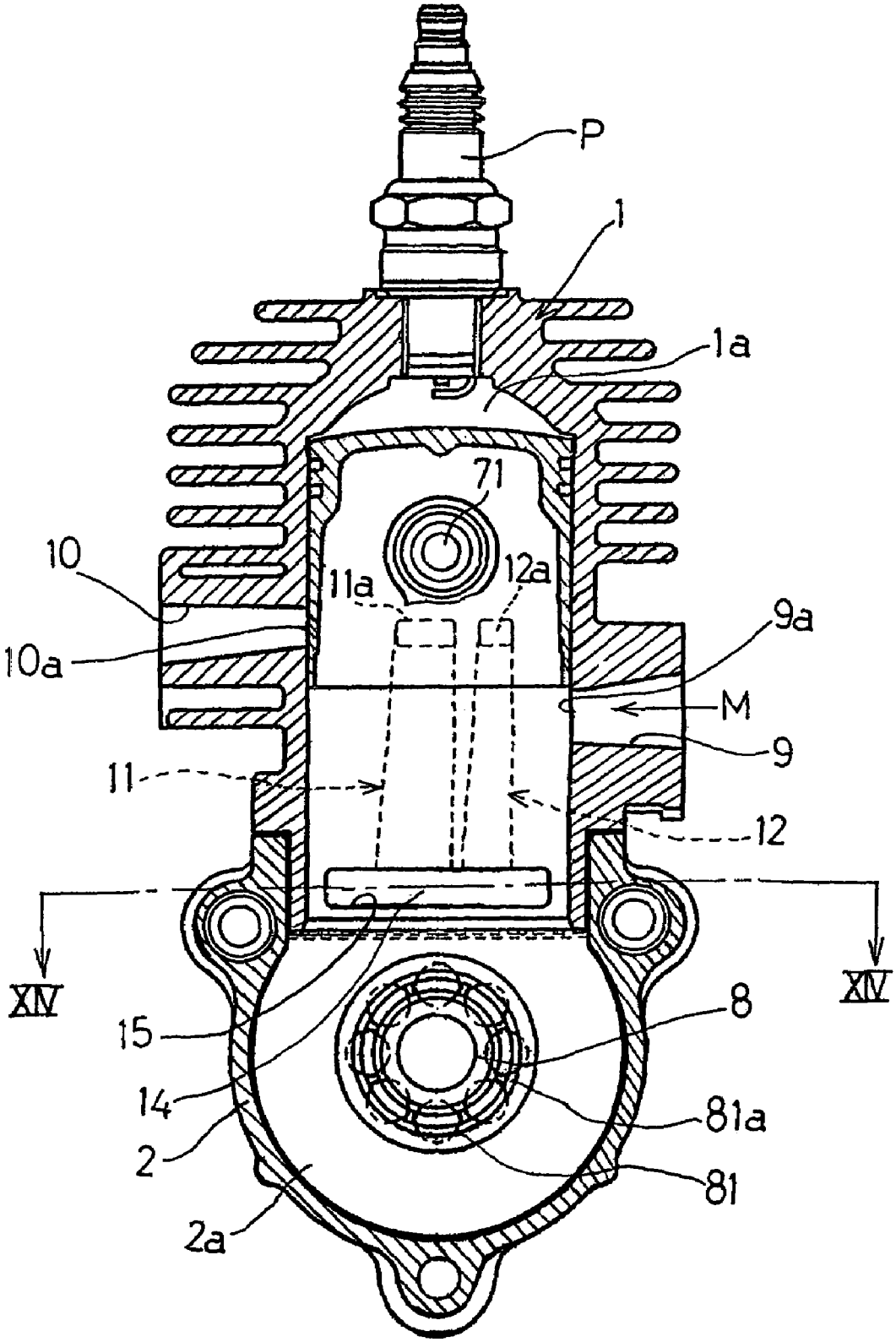
FIG. 13 is a longitudinal sectional view of a two-cycle internal combustion engine according to a sixth preferred embodiment of the present invention.
Figure 14:
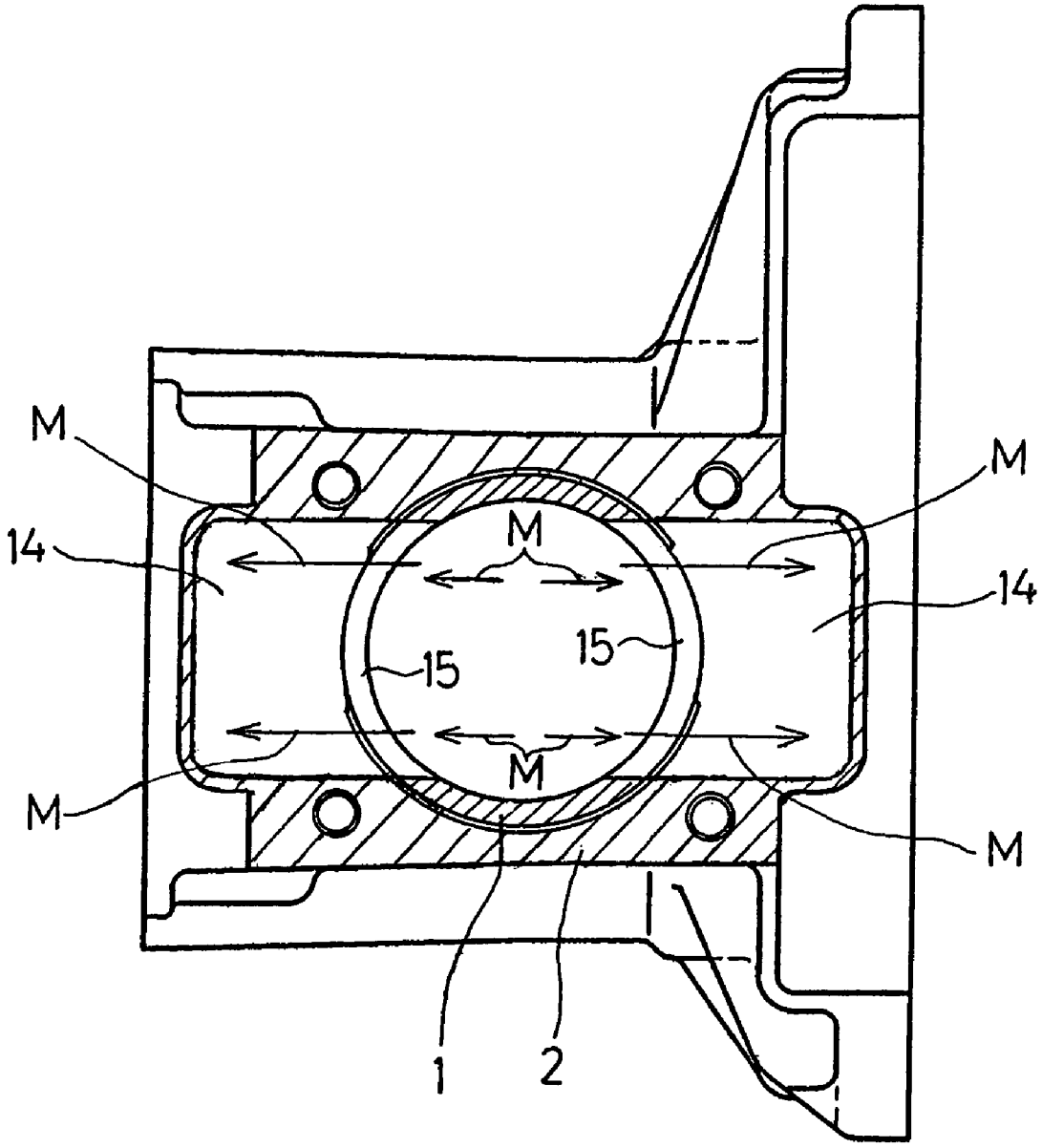
FIG. 14 is a cross-sectional view taken along the line XIV—XIV in FIG. 13.
Figure 15:
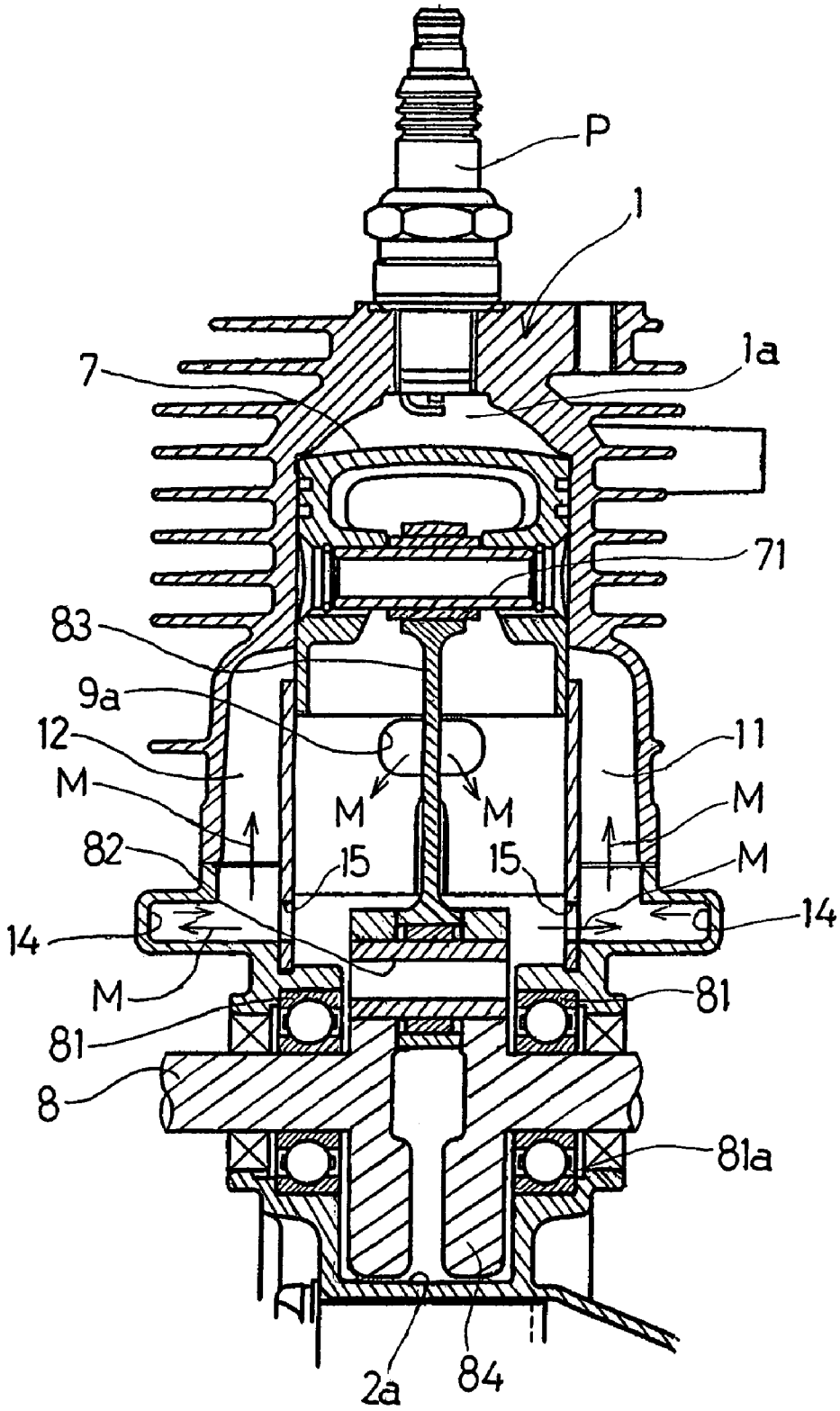
FIG. 15 is a longitudinal sectional view of the two-cycle internal combustion engine shown in FIG. 13, showing the details of the first and second scavenge passages.

The scavenging chamber 14 is formed in the crank case 2 to communicate with portions adjacent the lower ends of the respective scavenge passages 11 and 12 and extends in a substantially constant width radially outwardly from the scavenge inlet 15, as best shown in FIG. 14, so as to protrude radially outwardly from the scavenge passages 11 and 12 as best shown in FIG. 15. Also, as best shown in FIG. 13, this scavenging chamber 14 extends circumferentially a distance sufficient to straddle the first and second scavenge passages 11 and 12 so as to protrude circumferentially outwardly from respective circumferentially outer walls of the first and second scavenge passages 11 and 12. Accordingly, the air-fuel mixture M sucked from the intake port 9*a*, shown in FIG. 15, into the crank chamber 2*a* can flow once into the scavenging chamber 14 and then from the scavenging chamber 14 into main portions of the first and second scavenge passages 11 and 12. Since the lower ends of the first and second scavenge passages 11 and 12 do not extend down to the bearings 81, no air-fuel mixture M is introduced from the annular gaps 81*a* of the bearings 81 such as in the previously described embodiments.

It is to be noted that the scavenging chamber 14 of the structure described above may be employed in association with only one of the first scavenge passage 11 adjacent the exhaust port 10*a*, as shown in FIG. 13, and the second scavenge passage 12 adjacent the intake port 9*a*. It is also to be noted that the use of the scavenging chamber 14 can be equally applied to the two-cycle combustion engine with a scavenging system having no second scavenge passage 12.

The two-cycle internal combustion engine according to the sixth embodiment of the present invention operates in the following manner. In the first place, during the intake stroke, as the piston 7 nears the top dead center, the air-fuel mixture M, which is not atomized satisfactorily, is introduced from the intake port 9*a*, defined in the peripheral wall of the cylinder block 1, directly into the crank chamber 2*a* of the crankcase 1 below the cylinder block 1. During the subsequent scavenging stroke, as the piston 7 starts descending, the air-fuel mixture M within the crank chamber 2*a* is, by the action of its inertia force, introduced from the scavenge inlet 15, open at the inner peripheral surface of the cylinder block 1, once into the scavenging chamber 14 aligned with such scavenge inlet 15. The air-fuel mixture M so introduced into the scavenging chamber 14 collides against an inner wall surface of the scavenging chamber 14, as shown in FIG. 15, so as to flow backwardly so that the air-fuel mixture M can thus be mixed to facilitate atomization thereof and also to suppress the scavenging speed.

Therefore, during the scavenging stroke, not only can an abrupt injection of the air-fuel mixture M from the first and second scavenge ports 11*a* and 12*a*, shown in FIG. 13, into the combustion chamber 1*a* be prevented, but the air-fuel mixture M mixed and atomized within the scavenging chamber 14 can be supplied into the combustion chamber 1*a* through the first and second scavenge passages 11 and 12 by way of the first and second scavenge ports 11*a* and 12*a*. Accordingly, not only can the blow-off of the air-fuel mixture M be prevented, but the combustion efficiency of the air-fuel mixture M can also be increased.

Figure 16:
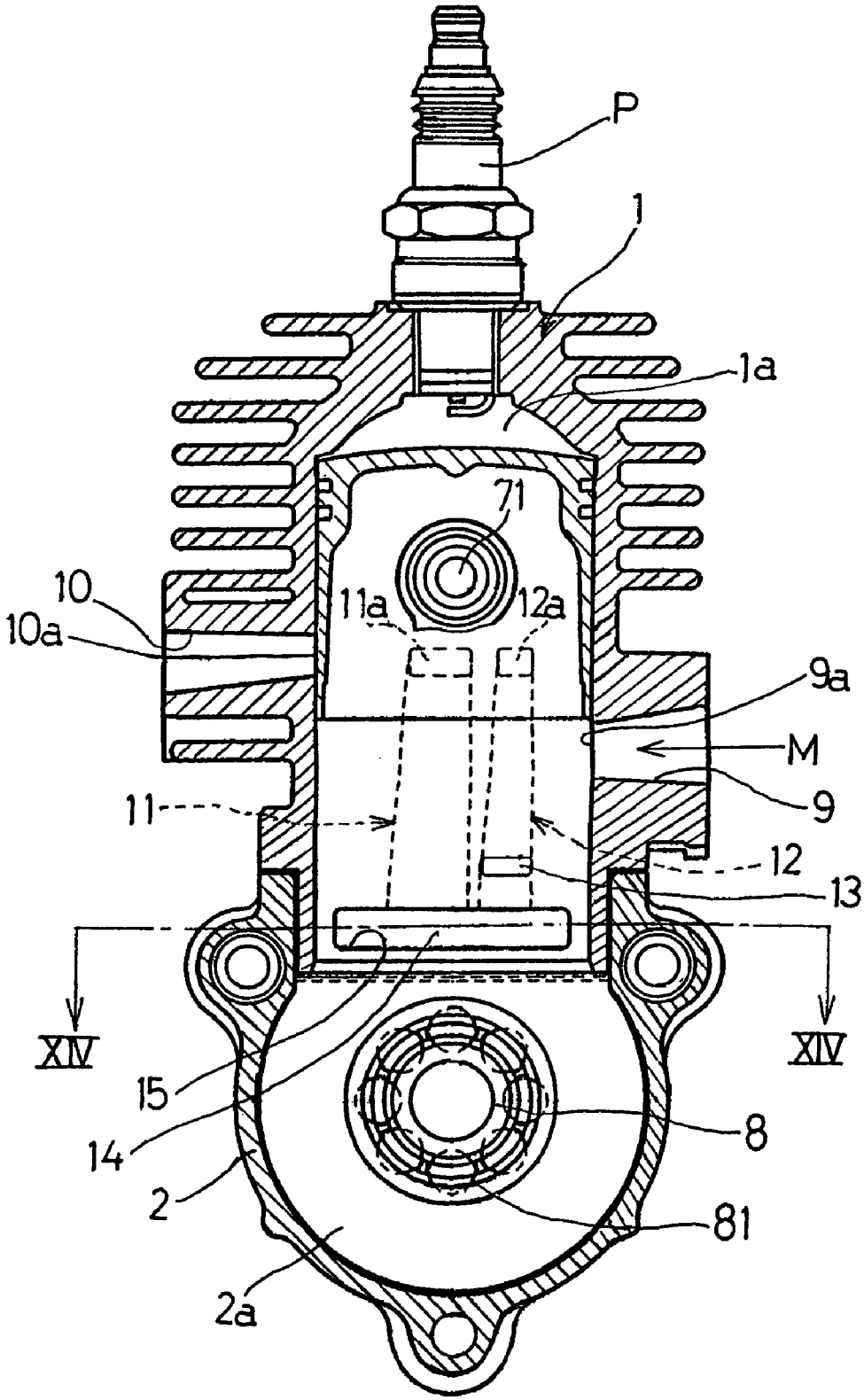
FIG. 16 is a transverse sectional view of a two-cycle internal combustion engine according to a seventh preferred embodiment of the present invention.

In a seventh embodiment of the present invention, as shown in FIG. 16, the introducing window 13 for fluid connecting between the crank chamber 2*a* and the second scavenge passage 12 is formed in a portion of the second scavenge passage 12 above the scavenging chamber 14. This introducing window 13 has a surface area or an opening area chosen to be smaller than the cross-sectional area of the second scavenge passage. According to this feature, since the relatively enriched air-fuel mixture M present in a portion of the crank chamber 2*a* distant from the crankshaft 8 can be introduced into the second scavenge passage 12 through the introducing window 13, an amount of the scavenging gas required to provide a high engine output can be easily obtained. Also, since the introducing window 13 is constricted, it is possible to suppress the occurrence of the blow-off phenomenon which is caused by a high speed flowing of the air-fuel mixture M within the crank chamber 2*a* into the second scavenge passage 12 through the introducing window 13.

It is to be noted that the introducing window 13 may be formed only in the first scavenge passage 11 or in both of the first and second scavenge passages 11 and 12.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A two-cycle combustion engine, which comprises:

a cylinder block having a cylinder bore defined therein and accommodating therein a reciprocating piston, said piston cooperating with the cylinder bore to define a combustion chamber;

a crankcase having a crank chamber defined therein and accommodating therein a crankshaft of the engine, said cylinder block being fixedly mounted on the crankcase with the cylinder bore communicated with the crank chamber;

said crankshaft being rotatably supported by the crankcase by means of a bearing; and a scavenging path having a plurality of pairs of scavenging passages defined in part within the cylinder block and in part within the crankcase for supplying an air-fuel mixture from the crank chamber into the combustion chamber, each pair having two scavenging passages confronting to each other, at least one of the scavenging passages having a lower end portion extended to a position where it is held in face-to-face relation with an outer end face of the bearing, such that the air-fuel mixture within the crank chamber is introduced into such scavenging passages mainly through the bearing, thereby to mix and atomize the air-fuel mixture by rotation of the bearing.

2. The two-cycle combustion engine as claimed in claim 1, further comprising an intake port for introducing the air-fuel mixture into the crank chamber and an exhaust port for discharging exhaust gases from the combustion chamber wherein the scavenging path comprises a pair of first scavenge passages defined adjacent the exhaust port and a pair of second scavenge passages defined adjacent the intake port, each of the first and second scavenge passages having a lower end portion extended to a position, where it is held in face-to-face relation with the outer end face of the bearing for the crankshaft, and communicated with the crank chamber through the bearing.

3. The two-cycle combustion engine as claimed in claim 2, wherein each of the first and second scavenge passages has a scavenge port; wherein the first scavenge passage has the lower end portion extended to the portion where it is held in face-to-face relation with the outer end face of the bearing for the crankshaft, and-wherein an uppermost edge of the scavenge port of each of the first and second scavenge passages is positioned at a level lower than that of the exhaust port and the uppermost edge of the scavenge port of the first scavenge passage is positioned at a level somewhat higher than that of the scavenge port of the second scavenge passage.

4. The two-cycle combustion engine as claimed in claim 2, further comprising an introducing window defined in a portion of the second scavenge passage above the bearing so as to open towards the crank chamber.

5. The two-cycle combustion engine as claimed in claim 4, wherein the introducing window has an opening area smaller than a cross-sectional surface area of the second scavenge passage.

6. The two-cycle combustion engine as claimed in claim 2, further comprising a connecting hole defined in the crankshaft for communicating the crank chamber with the lower end portion of the scavenging path.

7. The two-cycle combustion engine as claimed in claim 1 wherein the bearing is a rotary bearing that both restricts the flow path and mixes the air-fuel mixture with oil in a rotating action.

8. The two-cycle combustion engine as claimed in claim 1, further comprising a connecting hole defined in the crankshaft for communicating the crank chamber to the lower end portion of the scavenging path.

9. The two-cycle combustion engine as claimed in claim 8, wherein an outlet of the connecting hole opens in a direction counter to a direction towards a scavenge port of the scavenging path during a scavenging stroke in which a piston descends.

10. A two-cycle combustion engine, which comprises:

a cylinder block having a cylinder bore defined therein and accommodating therein a reciprocating piston, said piston cooperating with the cylinder bore to define a combustion chamber;

a crankcase having a crank chamber defined therein and accommodating therein a crankshaft of the engine, said cylinder block being fixedly mounted on the crankcase with the cylinder bore communicated with the crank chamber;

said crankshaft being rotatably supported by the crankcase by means of a rotary bearing unit; and a scavenging path defined in part within the cylinder block and in part within the crankcase for supplying an air-fuel mixture from the crank chamber into the combustion chamber, said scavenging path having a lower end portion extended to a position where it is in fluid connection with an outer end face of the bearing, such that the air-fuel mixture within the crank chamber is only introduced into the scavenging path through the rotary bearing unit that mixes the air-fuel mixture with oil in a rotating action wherein a suppression of a blow-off of the air-fuel mixture is provided.

11. The two-cycle combustion engine as claimed in claim 10 further comprising an intake port for introducing the air-fuel mixture into the crank chamber and an exhaust port for discharging exhaust gases from the combustion chamber wherein the scavenging path comprises a pair of first scavenge passages defined adjacent the exhaust port and a pair of second scavenge passages defined adjacent the intake port, each of the first and second scavenge passages having a lower end portion extended to a position, where it is held in face-to-face relation with the outer end face of the boring for the crankshaft, and communicated with the crank chamber through the bearing, wherein an uppermost edge of a scavenging port of each of the first and second scavenge passages is positioned at a lower level than that of an exhaust port communicating with the combustion chamber and the uppermost edge of the scavenge port of the first scavenge passage is positioned at a level higher than that of the scavenge port of the second scavenge passage.

* * * * *